US009148728B2

(12) United States Patent
Polster et al.

(10) Patent No.: US 9,148,728 B2
(45) Date of Patent: Sep. 29, 2015

(54) PIEZOELECTRIC PARTIAL-SURFACE SOUND TRANSDUCER

(75) Inventors: Steffen Polster, Nürnberg (DE); Andre Gerlach, Leonberg-Hoefingen (DE); Claudia Arnold, Stuttgart (DE); Stefan Zimmermann, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 13/882,248

(22) PCT Filed: Oct. 26, 2011

(86) PCT No.: PCT/EP2011/068757

§ 371 (c)(1),
(2), (4) Date: Jul. 8, 2013

(87) PCT Pub. No.: WO2012/055915

PCT Pub. Date: May 3, 2012

(65) Prior Publication Data

US 2013/0287232 A1 Oct. 31, 2013

(30) Foreign Application Priority Data

Oct. 29, 2010 (DE) ..... 10 2010 043 108

(51) Int. Cl.

| | |
|---|---|
| ***H04R 25/00*** | (2006.01) |
| ***H04R 17/00*** | (2006.01) |
| *H04R 19/02* | (2006.01) |

(52) U.S. Cl.

CPC ..... *H04R 17/00* (2013.01); *H04R 17/005* (2013.01); *H04R 19/02* (2013.01); *H04R 2201/401* (2013.01)

(58) Field of Classification Search

USPC ..... 381/111, 173, 190, 191

See application file for complete search history.

(56) References Cited

U.S. PATENT DOCUMENTS

| | | | | |
|---|---|---|---|---|
| 4,217,516 | A | 8/1980 | Iinuma et al. | |
| 4,638,207 | A | 1/1987 | Radice | |
| 4,656,384 | A | 4/1987 | Magori | |
| 6,178,246 | B1 * | 1/2001 | Bebesel et al. | 381/71.2 |
| 6,775,388 | B1 * | 8/2004 | Pompei | 381/191 |
| 8,094,843 | B2 * | 1/2012 | Eaton | 381/190 |
| 2003/0135135 | A1 | 7/2003 | Miwa et al. | |
| 2005/0281419 | A1 * | 12/2005 | Miyazaki et al. | 381/191 |
| 2007/0189560 | A1 * | 8/2007 | Uenishi et al. | 381/191 |

FOREIGN PATENT DOCUMENTS

| | | |
|---|---|---|
| DE | 43 43 807 | 6/1995 |
| JP | H0213099 | 1/1990 |
| JP | 2003175036 | 6/2003 |
| JP | 2004313484 | 11/2004 |
| JP | 2006094120 | 6/2006 |
| WO | WO0189723 | 5/2001 |

OTHER PUBLICATIONS

International Search Report for PCT/EP2011/068757, dated Feb. 2, 2012.

* cited by examiner

*Primary Examiner* — Davetta W Goins
*Assistant Examiner* — Amir Etesam
(74) *Attorney, Agent, or Firm* — Kenyon & Kenyon LLP

(57) ABSTRACT

A piezoelectric sound transducer using a piezoelectric plastic material is developed from a substrate layer and a layer of a piezoelectric plastic material deposited thereon, the piezoelectric plastic layer covering the substrate layer not completely but having openings.

11 Claims, 3 Drawing Sheets

PIEZOELECTRIC PARTIAL-SURFACE SOUND TRANSDUCER

BACKGROUND OF THE INVENTION

1. Field of the Invention

The present invention relates to a piezoelectric sound transducer which uses a piezoelectric plastic material. In particular, the present invention relates to a sound transducer which is essentially developed from a substrate layer and a layer of a piezoelectric plastic material deposited thereon, the piezoelectric plastic layer covering the substrate layer not in its entirety, but having openings.

2. Description of the Related Art

Sound transducers for converting electrical signals into acoustical signals and vice versa in various forms have been known in many technology fields for more than a hundred years. Different principles of electro-acoustic conversion are known. In addition to electromagnetic transducers as they are used in coil loudspeakers, for example, and electrodynamic or electrostatic transducers, as employed in microphones or headphones, for instance, piezoelectric sound transducers of the type used in ultrasonic sensors, for example, are known as well. Apart from the use of piezo ceramics, the use of piezoelectric plastics for converting electrical signals into acoustical signals and vice versa is known in the field of piezoelectric sound transducers. One known plastic material having piezoelectric properties is polyvinylidene fluoride (PVDF). The piezoelectric properties of PVDF form the basis of various sound transducer designs. Vapor deposition or sputtering methods, for example, are employed to deposit an electrically conducting surface on a PVDF foil. By applying an electrical field, the obtained structures may be used as sound emitters, or when using a charge transfer, as sound receivers. Another transducer principle is the piezo-composite principle, in which hard piezo materials, in particular, are combined with each other.

U.S. Pat. No. 4,638,207 describes the use of a piezoelectric polymer based on polyvinylidene fluoride (PVDF) to produce balloon-shaped loudspeakers. Toward this end, strips, which are made up of a PVDF polymer layer enclosed between an outer and an inner coating, are applied on a balloon, or the balloon itself is formed by a PVDF polymer layer enclosed between an outer and an inner coating.

In the described sound transducers on the basis of piezoelectric plastic materials, movement of the plastic layer occurs both in the layer plane, referred to as transverse expansion, and in the thickness direction of the layer, which is referred to as longitudinal expansion. However, the transverse expansion of the layer is locally impeded by the surrounding plastic material, which impediment occurs both in the transmitting operation, i.e., when using the sound transducer as loudspeaker, and in the receiving operation i.e., when using the sound transducer as microphone. This hindrance in the transverse expansion results in restricted dynamics of the sound transducer. In particular the deflection of the plastic layer out of the plane, which is required to generate or absorb a sound wave, is markedly restricted.

BRIEF SUMMARY OF THE INVENTION

The present invention provides a sound transducer, which includes a substrate layer and a layer of a piezoelectric plastic material deposited on the substrate layer, the substrate layer and the piezoelectric plastic layer being joined to each other in such a way that a dimensional change of the piezoelectric plastic layer leads to a deformation of the substrate layer, and vice versa, the piezoelectric plastic layer being provided with openings.

In the present invention, the fact that the plastic layer has openings means that the substrate layer is not fully covered by a piezoelectric plastic layer, but that there are areas of the substrate layer which are not covered by a piezoelectric plastic material. These uncovered regions may be distributed on the substrate layer both in symmetrical and asymmetrical fashion.

The provision of openings in the piezoelectric plastic layer according to the present invention markedly reduces the impeded transverse expansion, so that the dynamic properties of the transducer are improved.

In the present invention, the piezoelectric layer on the basis of a piezoelectric plastic material provided in a piezoelectric sound transducer thus is interrupted by air cavities, and the movement of the plastic material, in particular in the thickness direction, i.e. the deflection or the lift of the piezoelectric layer, is facilitated by reducing the impediment in the transverse expansion.

Suitable piezoelectric plastics are polyvinylidene fluoride (PVDF), polyvinylidene fluoride trifluoroethylene (PVDF-TrFE), or partially fluorinated or perfluorinated polymers on the basis of a polymer of the group consisting of polycarbonate (PC), polyimide (PI), polyurethane (PU), polymethyl (meth) acrylate (PMA/PMMA), polyolefins such as polyethylene or polypropylene (PE, PP). These plastics obtain their piezoelectric properties through polarization. In one preferred development of the present invention, the piezoelectric plastic layer of the sound transducer includes polyvinylidene fluoride (PVDF). Especially preferably, the piezoelectric plastic layer is a PVDF layer.

The piezoelectric plastic layer may be deposited on the substrate layer using different technologies. In particular, the layer may be applied by printing techniques, spraying techniques, sputtering techniques, spin-coating techniques, bonding techniques, lamination techniques or wiping techniques. When printing techniques are used to apply the piezoelectric plastic layer on a substrate layer, printing techniques such as known in particular from the circuit board production may be used to apply the piezoelectric plastic layer on the substrate layer in patterned form. Screen-printing techniques, transfer or sublimation printing techniques, offset printing techniques, or also non-impact techniques such as ink-jet printing techniques may be used, in particular.

In another development of the present invention, the piezoelectric plastic layer is applied on the substrate layer using bonding or lamination techniques. It may be the case that the piezoelectric plastic layer is provided in the form of a foil, which then is bonded to the substrate layer or laminated on top of the substrate layer. The patterning of the piezoelectric plastic layer may be carried out prior to bonding the foil to the substrate layer, or also afterwards. To pattern the foil, the openings to be provided may be cut out using a knife or a suitable laser.

The openings in the piezoelectric plastic layer may be such that discrete piezoelectric regions are created in the sound transducer. These discrete regions are able to be electrically interconnected in series or parallel. However, it may in particular also be the case that these discrete piezoelectric regions are controlled separately by suitable contacting and by employing corresponding control electronics. This makes it possible to combine the individual discrete piezoelectric plastic layer regions of the sound transducer into a sound transducer array.

The substrate layer in a sound transducer according to the present invention in turn may be a foil, e.g., a plastic or metal foil, or it may be made of a different material offering sufficient flexibility to be deflected by the piezoelectric plastic material when a corresponding signal is applied, or in order to produce a charge transfer in the piezoelectric layer in a deflection caused by a sound wave impinging on the substrate layer.

A contact or electrode surface may be applied on the piezoelectric plastic layer for its electrical contacting. For example, this may be done by vapor deposition, sputtering or galvanic deposition of a conducting metal layer in a subregion of the piezoelectric plastic layer. Using this electrical contacting, the sound transducer according to the present invention is able to be connected to a suitable signal source for a sound signal, or to an evaluation device for converting the sound wave impinging on the sound transducer into an electrical or digital signal, possibly with an interconnection of adaptation devices such as signal amplifiers, for instance.

In one further development of the present invention, the substrate layer is at least partially developed as electrode. The substrate layer may be conductive for this purpose, at least in subregions. In another development, the entire substrate layer is electrically conductive and may thus be used as electrode across the entire contact region provided with the piezoelectric plastic layer. Suitable materials for use as substrate layer in such a development are, for example, metal foils or electrically conducting plastic foils, e.g., on the basis of intrinsically conducting polymers such as polyaniline, polythiophene, polyacetylene or polypyrrole, or also by suitable doping with conducting particles such as aluminum particles or soot, plastics made electrically conducting on the basis of PC, PMA, PMMA, PE, PET, PTFE, PU, PP or the like.

In one further development of the present invention, the piezoelectric plastic layer is delimited by a substrate layer on both sides, so that a sandwich structure is produced. It may be the case that one or both substrate layer(s) is/are conducting, at least in subregions. Because of the two-sided provision of a carrier foil and the resulting sandwich structure, the effective surface for the sound emission or the sound reception is enlarged, which leads to a further improvement in the dynamics of the sound transducer.

The provision of a carrier foil on both sides furthermore makes it possible for the sound transducer to work as electrostatic sound transducer in the region of the openings of the piezoelectric plastic layer. It may be provided, in particular, that the regions of the piezoelectric activity, i.e., the regions in which the carrier foils are covered by the piezoelectric plastic layer, and the regions of the electrostatic activity, i.e., the regions in which the piezoelectric layer has openings, are controlled in electrically separate manner. It may also be the case that the sound transducer is used for sound emission in the regions in which it is operating as piezoelectric sound transducer, whereas it is used for sound reception in the regions in which it is operating as electrostatic sound transducer. Such a development in particular allows the sound transducer to be used as human/machine interface (HMI), for instance in the area of computer technology, mobile radio communication technology, or in the automotive field.

The sound transducers according to the present invention in particular may be used in outside areas exposed to the elements, or in wet spaces.

In the following text the sound transducers according to the present invention are discussed in greater detail based on the figures and exemplary embodiments.

DETAILED DESCRIPTION OF THE INVENTION

Figure 1:
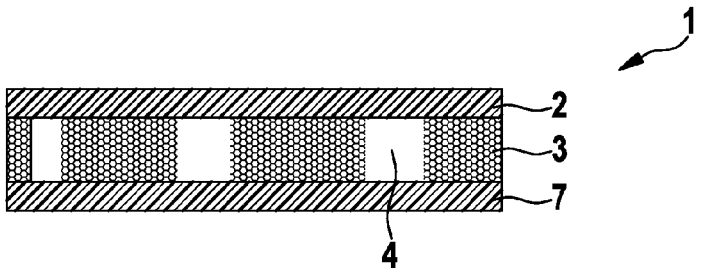
FIG. 1 through FIG. 5 show different developments of a sound transducer according to the present invention.

FIG. 1 shows a sound transducer 1 according to the present invention, in which a layer 3 of a piezoelectric plastic has been applied on a substrate foil 2, which is made of an electrically conducting material such as an electrically conducting plastic foil or metal foil. The piezoelectric plastic layer does not cover substrate foil 2 in its entirety, but instead has opening 4. Substrate foil 2 and piezoelectric layer 3 are connected to each other such that a change in the dimensions of piezoelectric plastic layer 3 leads to a deformation of substrate layer 2, and vice versa. Opening 4 minimizes the impeded transverse expansion of the piezoelectric plastic layer, and thereby allows a greater overall deflection of substrate foil 2. This improves the dynamics of the sound transducer. In the exemplary embodiment of the sound transducer according to the present invention shown in FIG. 1, substrate foil 2 simultaneously forms an electrode for the electrical contacting of piezoelectric plastic layer 3. As can furthermore be gathered from the figure, a further layer 7 may be provided, which is likewise developed as electrically conducting foil in the exemplary embodiment shown and thus forms an electrode as well. Layers 2, 3 and 7 form a sandwich-type structure. Piezoelectric plastic layer 3 may be applied on the substrate foil using different techniques, but printing, spin-coating and lamination techniques are preferred in this context. Further layer 7 may be applied using lamination techniques.

Figure 2:
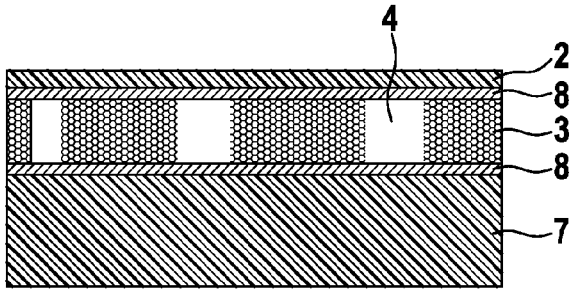

FIG. 2 shows another development of a sound transducer according to the present invention, in which an electrode layer 8 for the electrical contacting of piezoelectric plastic layer 3 is situated between substrate layer 2 and piezoelectric plastic layer 3. This development of the sound transducer is also shown as sandwich structure, in which piezoelectric plastic layer 3 is delimited by a further layer 7 on the side lying opposite substrate layer 2. Once again, an electrode layer 8 is disposed between further layer 7 and piezoelectric layer 3. Substrate layer 2 and further layer 7 may be formed from the same or also from different materials in order to optimize the oscillation behavior of the sound transducer. In the same way, substrate layer 2 and further layer 7 may have different thicknesses, the layer thickness preferably being variable in a range between 5 μm and 500 μm. Further layer 7 may at least partially also be formed by a body such as a housing or a housing part, for example. The body is also able to serve as support of the sound transducer. The layer thickness of the piezoelectric plastic layer preferably lies in a range of <100 μm. Electrode layer 8 is able to be applied on layers 2 and 7 using conventional coating techniques, such as a galvanic deposition, sputtering, vapor deposition, or it may also be formed by an electrically conducting foil which is bonded to layers 2 or 7 or laminated thereto. As a final production step of the sound transducer, the layers or the layer composite may then be joined using bonding or lamination techniques.

Figure 3:
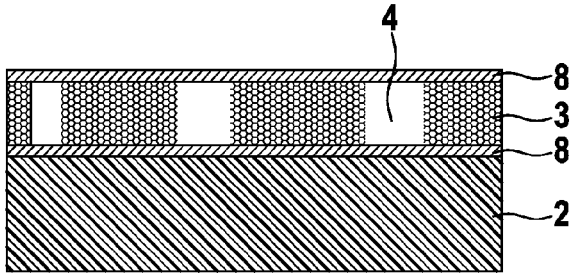

FIG. 3 shows a development of a sound transducer according to the present invention that has a layer sequence of substrate layer 2, electrode layer 8, piezoelectric plastic layer 3, electrode layer 8. Electrode layers 8 are preferably made of electrically conducting foils. This sandwich composite is likewise able to be produced in the manner described in connection with FIG. 2.

Figure 4:
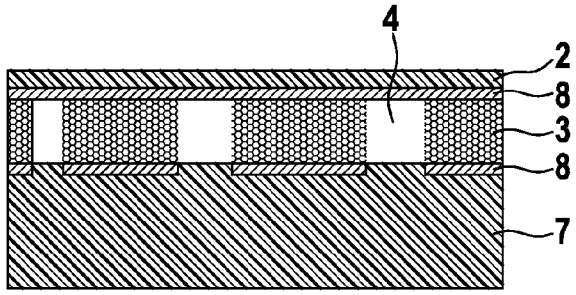

FIG. 4 shows a sound transducer which is identical to the sound transducer shown in FIG. 2 as far as the layer sequence is concerned, but in which at least one of electrode layers 8 is interrupted in the region of openings 4 of piezoelectric plastic layer 3. This development of a sound transducer according to the present invention allows a further adaptation of the oscillatory behavior because the influence of electrode layers 8 on the oscillatory behavior is reduced.

Figure 5:
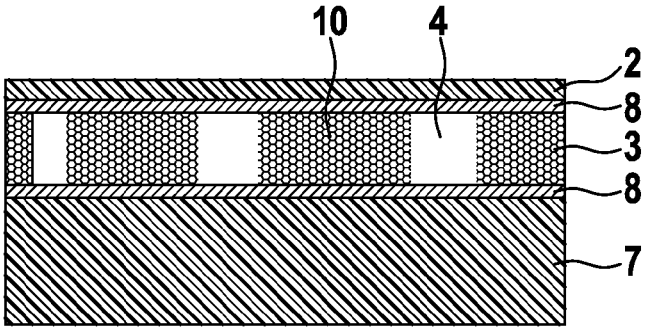

FIG. 5 shows a development of a sound transducer according to the present invention whose layer sequence is similar to the specific development shown in FIG. 2. In the specific development shown, the sound transducer operates as an electrodynamic sound transducer in region 10, in which piezoelectric plastic layer 3 is disposed, while it is operating as electrostatic sound transducer in the region of opening 4. The selective combination of electrodynamic and electrostatic sound conversion makes it possible to optimize the dynamics of the sound transducer. In the sound transducer according to the present invention, such an optimization is able to be achieved simply by a suitable design and distribution of opening 4 in piezoelectric plastic layer 3.

Figure 6:
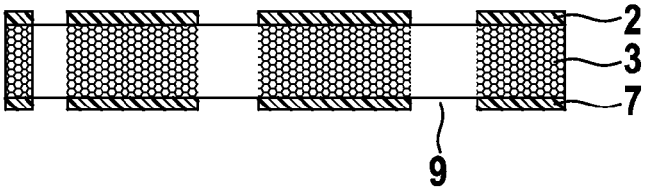
FIG. 6 shows one development of a sound transducer provided with perforations according to the present invention.

FIG. 6 shows a development of a sound transducer according to the present invention, in which openings 9 are provided which exist not only in piezoelectric layer 3 but also in substrate layer 2 and further layer 7. In the specific development shown, substrate layer 2 and further layer 7 serve as electrode as well, as explained in connection with FIG. 1, for the electrical contacting of piezoelectric layer 3. The specific embodiment shown is able to be produced in a simple manner, as self-contained layer composite having the layer sequence of substrate layer 2, piezoelectric plastic layer 3, further layer 7, from which opening 9 is subsequently cut out by means of cutting or stamping techniques. This makes for a simple and cost-effective production process. For example, it is possible to provide a honeycomb-like distribution of openings 9 in the plane of the sound transducer.

Figure 7:
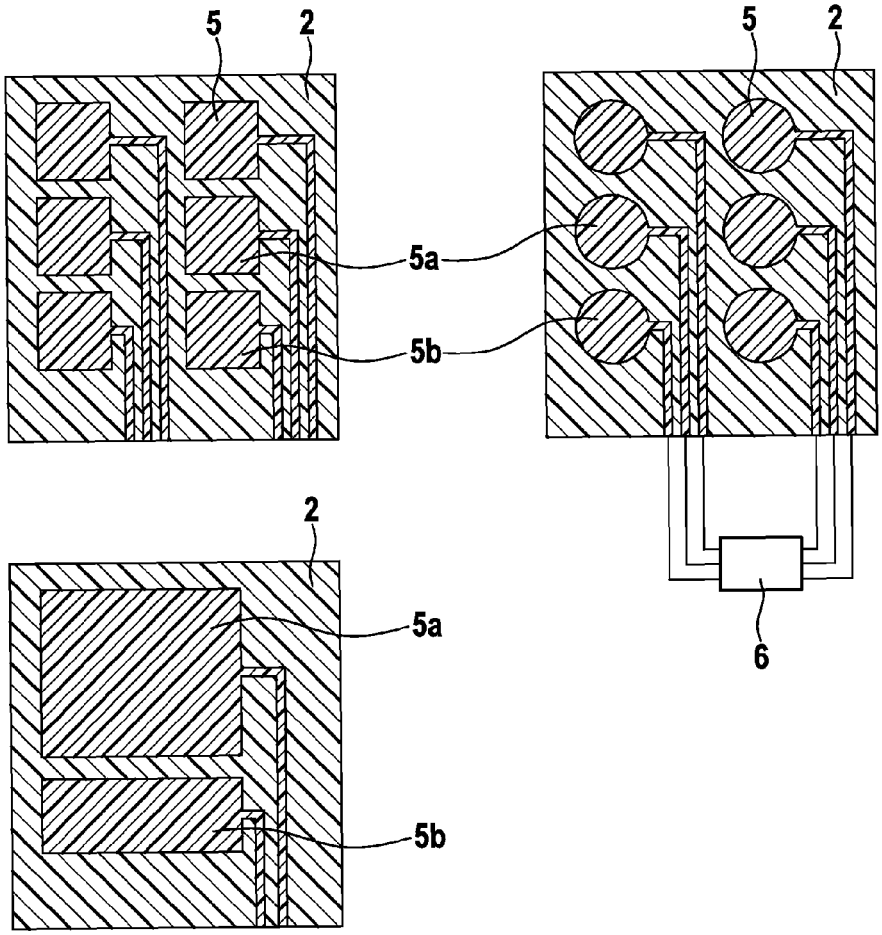
FIG. 7 shows different array systems of sound transducers according to the present invention.

FIG. 7 shows the sound transducer according to the present invention with different distributions of the piezoelectrica-plastic layer on a substrate layer 2, the piezoelectric plastic layer forming discrete regions 5. The discrete piezoelectric plastic layer regions 5 may be controlled separately with the aid of control electronics 6. One discrete region 5*a*, for example, may be provided for the sound generation, while a discrete region 5*b* is provided for sound reception. This makes it possible to provide a sound transducer which is able to operate both as loudspeaker and as microphone. Such a development is particularly advantageous when the sound transducer is used as HMI (human-machine interface), since the two functionalities of sound generation and sound reception are able to be combined with each other in one sound transducer in a very space-saving manner.

What is claimed is:

1. A sound transducer, comprising:

a substrate layer; and a layer of a piezoelectric plastic material deposited on the substrate layer;

wherein:

the substrate layer and the piezoelectric plastic layer are joined to one another such that a change in the dimensions of the piezoelectric plastic layer leads to a deformation of the substrate layer, and a change in the dimensions of the substrate layer leads to a deformation of the piezoelectric plastic layer;

the piezoelectric plastic layer is provided with openings configured in such a way that the piezoelectric layer forms a plurality of discrete sections on the substrate surface; and at least one section of the discrete piezoelectric plastic layer sections is operated as a microphone, and at least one section of the discrete piezoelectric plastic layer sections is operated as a loudspeaker, via the control electronics.

2. The sound transducer as recited in claim 1, wherein the sound transducer is configured for use outdoors, exposed to weather elements including moisture.

3. The sound transducer as recited in claim 1, wherein the substrate layer is at least partially configured as an electrode.

4. The sound transducer as recited in claim 3, wherein the discrete piezoelectric plastic sections are configured to be controlled individually via control electronics.

5. The sound transducer as recited in claim 1, wherein the discrete piezoelectric plastic sections are configured to be controlled individually via control electronics.

6. The sound transducer as recited in claim 1, wherein the piezoelectric plastic layer forms a sandwich structure together with the substrate layer and a further layer, the piezoelectric plastic layer constitutes a center layer of the sandwich structure, and the openings are provided in only the piezoelectric plastic layer of the sandwich structure.

7. The sound transducer as recited in claim 6, wherein the discrete piezoelectric plastic sections are configured to be controlled individually via control electronics.

8. The sound transducer as recited in claim 6, wherein the substrate layer is at least partially configured as an electrode.

9. The sound transducer as recited in claim 1, wherein the piezoelectric plastic material has polyvinylidene fluoride (PVDF).

10. The sound transducer as recited in claim 9, wherein the piezoelectric plastic material is applied on the substrate layer by one of printing, spraying, sputtering, bonding, lamination, or wiping technique.

11. The sound transducer as recited in claim 1, wherein the discrete piezoelectric plastic layer sections are electrically interconnected at least one of in series and parallel.

* * * * *